US007501935B2

(12) United States Patent
Keeler et al.

(10) Patent No.: US 7,501,935 B2
(45) Date of Patent: Mar. 10, 2009

(54) MULTI-FREQUENCY FIRE ALARM SOUNDER

(75) Inventors: Manley S. Keeler, Naperville, IL (US); Charles F. Fisler, Sycamore, IL (US); Simon Ha, Aurora, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/924,364

(22) Filed: Oct. 25, 2007

(65) Prior Publication Data

US 2008/0048841 A1 Feb. 28, 2008

Related U.S. Application Data

(63) Continuation of application No. 11/008,595, filed on Dec. 9, 2004, now abandoned.

(51) Int. Cl.
*G08B 3/00* (2006.01)

(52) U.S. Cl. ..... 340/384.7; 340/404.1

(58) Field of Classification Search ..... 340/384.7, 340/404.1, 384.4, 328, 329, 309.16, 309.7; 200/67 R, 147, 241
See application file for complete search history.

(56) References Cited

U.S. PATENT DOCUMENTS

| | | | | |
|---|---|---|---|---|
| 3,051,944 | A * | 9/1962 | Smith | 340/384.4 |
| 4,250,500 | A * | 2/1981 | Schade, Jr. | 340/628 |
| 4,796,009 | A * | 1/1989 | Biersach | 340/388.4 |
| 4,954,805 | A * | 9/1990 | Buyak | 340/384.6 |
| 4,980,837 | A * | 12/1990 | Nunn et al. | 340/384.4 |
| 5,633,625 | A * | 5/1997 | Gaub et al. | 340/438 |
| 5,675,312 | A * | 10/1997 | Burnett | 340/384.72 |
| 5,793,282 | A * | 8/1998 | Arnold et al. | 340/384.6 |
| 5,990,797 | A * | 11/1999 | Zlotchenko et al. | 340/628 |
| 6,201,470 | B1 * | 3/2001 | Withington | 340/384.7 |
| 6,646,548 | B2 * | 11/2003 | Dornfeld | 340/384.4 |
| 6,650,232 | B1 * | 11/2003 | Strohbeck et al. | 340/384.7 |

* cited by examiner

*Primary Examiner*—Eric M Blount
(74) *Attorney, Agent, or Firm*—Husch Blackwell Sanders Welsh & Katz

(57) ABSTRACT

An audible output device, of a type usable in a fire alarm system, incorporates a multi-frequency waveform generator. The generator produces a plurality of frequencies with predetermined duty factors during various time intervals on a repetitive basis. The multi-frequency drive signal is in turn coupled to an audible output device such as a piezoelectric horn or the like. The multi-frequency audio output provides an indicator to persons adjacent to the device of the presence of an alarm condition.

19 Claims, 2 Drawing Sheets

MULTI-FREQUENCY FIRE ALARM SOUNDER

CROSS-REFERENCE TO RELATED APPLICATIONS

The present application is a Continuation of and claims the benefit of the filing date of U.S. Utility application Ser. No. 11/008,595 filed on Dec. 9, 2004 entitled "Multi-Frequency Fire Alarm Sounder," which is incorporated herein by reference.

FIELD OF THE INVENTION

The invention pertains to fire alarm indicating devices which emit audible outputs. More particularly, the invention pertains to such devices, such as horns or the like, which might be driven by multi-frequency input signals.

BACKGROUND OF THE INVENTION

It has been known in the prior art to drive a horn or other form of audible output transducer at a single frequency to indicate an alarm condition. In an indoor environment, single frequency driving of the horn or transducer can produce a complex set of zones of unacceptably low sound intensity. These are thought to arise from standing waves caused by the sound waves reflecting from surfaces, such as room surfaces, and a region being monitored.

The location of such low intensity zones is a function both of the frequency of the emitted sound from the transducer, or horn, as well as the locations of the reflective surfaces within the range of the sound. These zones will be substantially fixed in space for a specified frequency. The presence of unacceptably low sound intensity zones results in a circumstance where an alarm might not be clearly heard by a person who happened to be in any such zone.

FIG. 1 illustrates prior art drive circuitry 10 usable with sounders or other audible alarm emitting devices. Such devices would be suitable for use in fire monitoring systems.

Circuitry 10 includes a power source 12, which might be controllable, coupled to a single frequency wave form generator 14. The output of generator 14 can be amplified, amplifier 16, and then fed to an audible output transducer such as a piezoelectric horn 18. It will be understood that the circuit 10 is of a type which might be incorporated into a housing and pluralities of such devices might be distributed throughout a region being monitored. When activated, horn 18 emits outputs responsive to single frequency driving signals on line 16*a*.

There continues to be a need for audible alarm indicating output devices which minimize or eliminate the presence of low sound intensity zones. Preferably, such improved devices would also project their output sound through doors and walls in the immediate area. In addition to improving sound penetration characteristics of such devices, it would also be desirable to be able to minimize power consumption on a per device basis since a given fire alarm system might incorporate a large number of such devices.

DETAILED DESCRIPTION OF THE EMBODIMENTS

Figure 1:
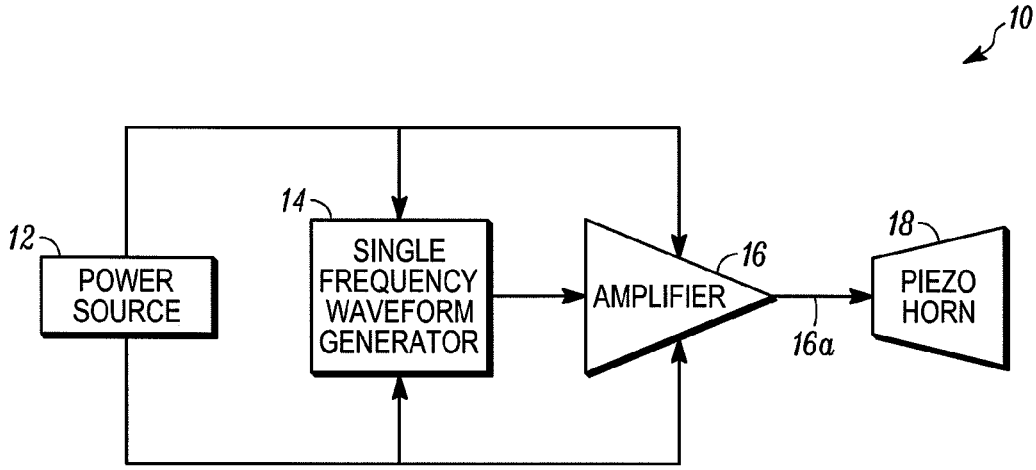
(PRIOR ART) FIG. 1
FIG. 1 is a block diagram of a prior art, mono-frequency sounder drive circuit.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

An audible output device which embodies the invention incorporates a rapidly changing set of frequencies to drive an audible output transducer. Since each frequency produces a different set of standing waves within the immediate vicinity of the device, rapidly varying the frequencies also rapidly changes the locations of the standing waves, hence, also changing the location of zones of low sound intensity.

As a result of repetitively changing the locations of relatively low sound intensity in a region or a room, it is highly unlikely that a person in the region or room would be in a zone which exhibits unacceptably low sound intensity for all frequencies. Thus, some or all zones or regions in the vicinity of the device can be expected to exhibit acceptable levels of alarm indicating sound intensity for at least some of the frequencies. Further, an output device which embodies the invention can provide a range of frequencies ranging from relatively low to relatively high audible frequencies. An opportunity is thus provided to emit relatively low frequencies which tend to penetrate walls and doors better than higher frequencies.

A disclosed embodiment of the invention incorporates a transducer such as a horn or a piezoelectric transducer which is used to convert electrical energy to audible or sound energy. Drive circuitry provides an appropriate range of electrical waveforms, for example, by using a plurality of single frequency oscillators, or a single variable frequency oscillator, to drive the output transducer across the desired range of frequencies.

The sources of the various generated frequencies can also include, all without limitation, random noise sources combined with selectable filters, custom integrated circuits as well as programmable devices which can produce the desired sequences of frequencies.

An amplifier can be provided to amplify the various frequency waveforms to the power level or levels required by the transducer. Characteristics of any particular audible output transducer are not limitations of the present invention. Transducers can be implemented using loud speakers, mechanical horns, buzzers, piezoelectric devices, all without limitation.

The amplifier, if incorporated, could be implemented using one or more solid state devices, such as transistors, integrated circuits, such as comparators, or operational amplifiers, as well as vacuum tubes, if desired.

In a disclosed embodiment, a piezoelectric transducer is coupled in parallel with an inductor. A programmed processor, programmed to output the desired frequencies and the desired sequence drives an optional solid state amplifier, which could incorporate one or more transistors. The output of the amplifier is coupled to the transducer.

In one aspect of the invention, each of the selected frequencies of a set can be applied for a predetermined period of time followed sequentially by each of the other predetermined frequencies of the set. Once the last frequency has been emitted by the transducer, the process can be repeated. It will be understood that frequencies could be presented randomly.

Those of skill will understand that each of the frequencies of the set can be emitted with a different time duration and duty cycle from each of the others. Hence, the electrical parameters of such as durations and duty cycles can be selected to produce the maximum sound output for the lowest power input for the selected transducer. Further, depending on the transducer characteristics, high current frequencies or frequencies which are emitted at relatively low intensities can be avoided. Alternately, the electrical parameters can be selected to provide maximally intrusive sound characteristics associated with "harshness" or "raspiness" where the devices are used in residences, hotels or motels for the purposes of awakening sleeping individuals.

Figure 2:
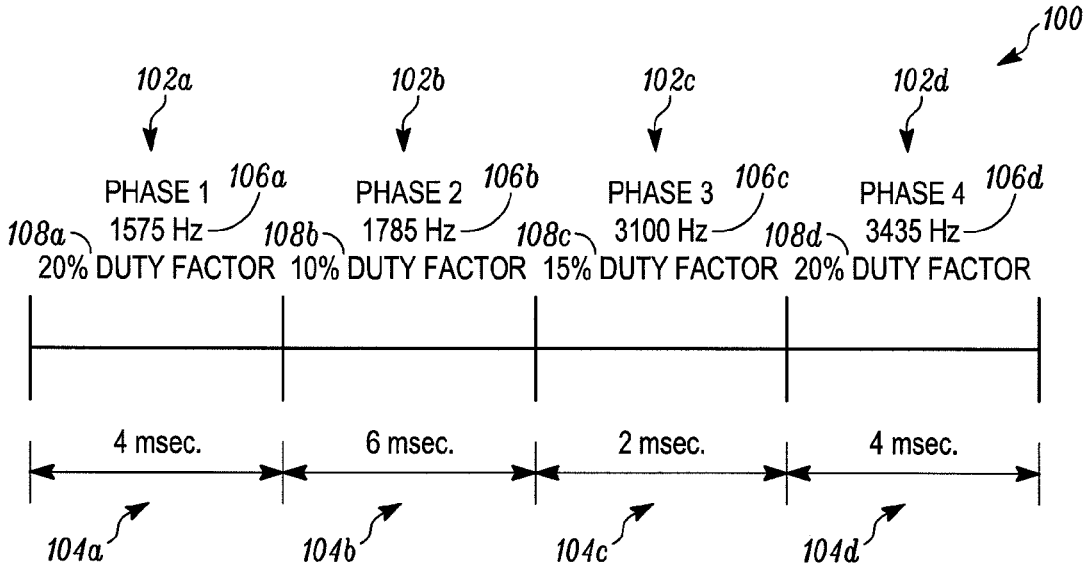
FIG. 2 is a graph illustrative of a method in accordance with the invention.

FIG. 2 is a graph illustrating a method of driving an audible output device, such as a piezoelectric horn, on a repetitive basis. In accordance with the method 100 a plurality of time intervals is established which, as those of skill in the art will understand, can be as few as two intervals and more than 6 or 8 if desired. The four intervals illustrated in FIG. 2 are exemplary only and do not represent limitation of the present invention. Each of the intervals 102*a, b, c, d* is associated with a predetermined time duration such as the respective time durations 104*a, b, c, d*. The time durations, which could be identical if desired, are associated with respective output frequencies 106*a, b, c, d*. Each of the output frequencies has an associated duty factor 108*a, b, c, d*.

The frequencies and duty factors can be selected as would be understood by those skilled in the art to not only minimize current requirements for the respective output device but also to maximize sound output. The sequence of method 100 would be repetitively presented to the associated output device thus creating a sequence of audible outputs, different frequencies, and having different duty cycles. As noted above, the use of different frequencies and different duty cycles, along with potentially different time durations, minimizes the likelihood of low sound intensity zones being formed in the region being monitored and into which the audible alarm is being projected.

Figure 3:
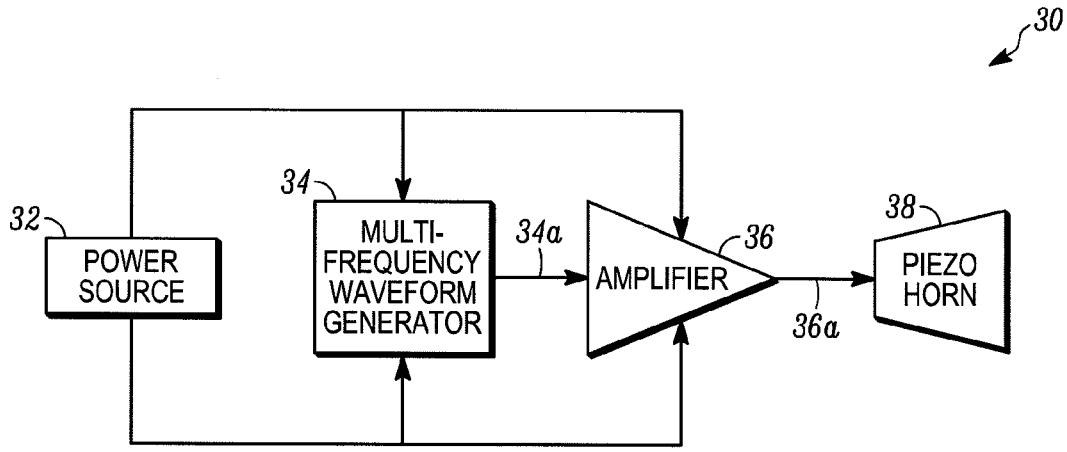
FIG. 3 is a block diagram of a sounder drive circuit in accordance with the invention.

FIG. 3 illustrates circuitry 30 for implementing the method 100 of FIG. 2. Circuitry 30 includes a local or remote, possibly switchable, power source 32. Power source 32 energizes a multi-frequency wave form generator 34.

The generator 34 is of a type which repetitively emits output signals in accordance with the process 100 of FIG. 2. The multi-frequency wave form generator 34 can be implemented using a plurality of single frequency oscillators, a variable frequency oscillator, a random noise source with selectable filters, a custom integrated circuit, a programmed microprocessor as well as any other multi-frequency wave form generating circuits.

The frequencies at the duty factors during the respective time intervals are emitted from the generator 34 on line 34*a* and can be amplified, as needed, in optional amplifier 36. The amplifier 36 can be implemented with one or more solid state devices such as transistors, operational amplifiers, comparators, or vacuum tubes all without limitation.

The amplified output on line 36*a* is coupled to the selected audible output device 38 which could be implemented for example as a piezoelectric horn. Alternately, transducer 38 could be implemented with a loud speaker, mechanical horn, buzzers, or any other type of audible output transducer suitable for generating an alarm indicator.

Figure 4:
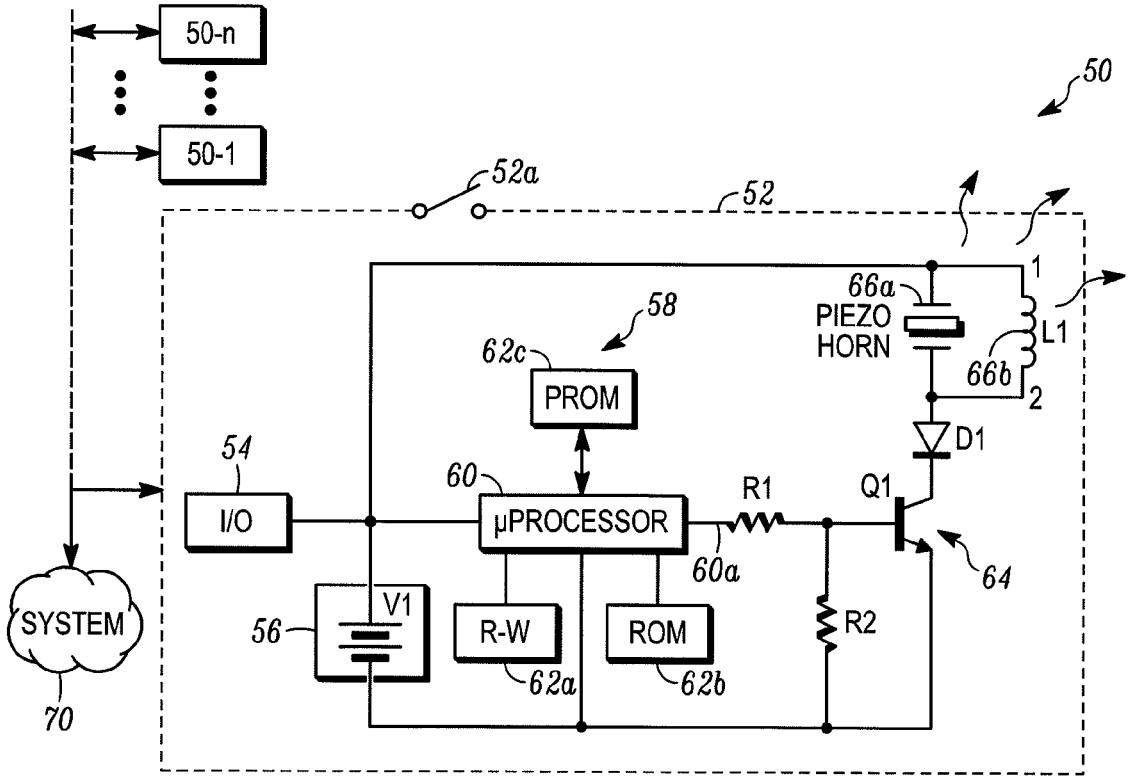
FIG. 4 is a more detailed schematic of the circuit of FIG. 3 illustrated as part of a fire alarm system.

FIG. 4 illustrates an audible alarm indicating output device 50. The device 50 can be carried in a housing, illustrated in phantom 52.

The device 50 includes input and output circuitry 54 as appropriate for coupling to other devices and control loops of a type found in fire alarm control systems. Such loops as known to those skilled in the art are used to power and provide communications to and from pluralities of output devices such as audible output device 50.

The device 50 further includes a local power source 56 which might be self contained or which might receive electric energy via port 54 from a remote system. A multi-frequency wave form generator 58 is implemented with a programmed processor 60.

The processor 60 is coupled to read/write memory 62*a*, read only memory 62*b*, and programmable read only memory 62*c*. It will be understood that neither the exact combination of memory types nor the sizes thereof are limitations of the present invention. The storage units, such as 62*a, b, c* could alternately be, in whole or in part, integrated with processor 60 as would be understood by those of skill in the art.

Those of skill will understand that control software or executable instructions carried in read-only-memory 62*b* or programmable read-only memory 62*c* can be of various sizes depending on the nature and extent of the functions being carried out and would thus adjust the size of the respective memory units 62*b, c* accordingly. The control programs of memory unit 62*b, c* when executed by processor 60 generate a plurality of repetitive wave forms in accordance with the method 100 previously discussed on line 60*a*.

Line 60*a* is in turn coupled to a single transistor output amplifier 64. The amplifier 64 is in turn coupled to a piezoelectric transducer 66*a* coupled in parallel with an inductor 66*b* as would be understood by those skilled in the art. Audible output sequences, in accordance with method 100, output by transducer circuitry 66*a, b* would in turn be emitted from housing 52 into that portion of the region being monitored adjacent to the housing 50. It will be understood that variations in the above circuitry, such as excluding the inductor 66*b*, could be effected by those of skill in the art without departing from the spirit or scope of the invention.

A plurality of audible output devices such as the device 50 could be installed in a variety of locations within a region R being monitored. Such output devices could be activated all at once or only on a regional basis as would be understood by those skilled in the art.

The devices 50, 50-1 . . . 50-n could be in communication with a regional monitoring system 70 as would be understood by those of skill in the art. Monitoring system 70 could correspond to one or more of a fire monitoring system, a burglary alarm system, a gas monitoring system, a flood warning system, or a chemical spill detection system, all without limitation.

It will also be understood by those skilled in the art that selected frequencies 106*a, b, c, d* could be selected as lower frequencies so as to better penetrate walls and doors, as opposed to higher frequencies. During some of the other time intervals 104*a, b, c, d* higher frequency outputs could be generated.

Output intensity levels can be manually set by a manually operable member 52*a*. Member 52*a* could include one or more switches, jumpers or the like all without limitation. The setting of the member 52*a* can be detected by processor 60. Processor 60 can in turn adjust one or more of output frequencies, duty cycles or time intervals in accordance therewith.

The outputs from processor 60 can be digital. Alternately, they can be converted to analog by means of a digital-to-analog converter.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An alarm indicating output device comprising:

an output transducer;

a digital source of a plurality of different driving frequencies coupled to the transducer, the source includes circuits to sequentially and repetitively couple members of the plurality of different frequencies, one at a time to the transducer during respective time intervals, and the source includes circuits to establish a respective duty cycle associated with each of the frequencies, each duty cycle being less than 100% with some of the duty cycles different from others and with some of the time intervals different from others.

2. A device as in claim 1 where the digital source comprises, at least in part, a programmed processor and associated control software to sequentially produce the plurality of driving frequencies.

3. A device as in claim 2 which includes a housing which carries the transducer and the source.

4. A device as in claim 3 which includes input circuitry for coupling a signal from a displaced system to the source thereby activating same to energize the transducer.

5. An alarm indicating output device comprising:

an output transducer;

a digital source of a plurality of different driving frequencies coupled to the transducer, the source includes circuits to sequentially couple members of the plurality of different frequencies, one at a time to the transducer during respective time intervals, and the source includes circuits to establish a respective duty cycle associated with each of the frequencies, each duty cycle being less than 100% with some of the duty cycles different from others and with some of the time intervals different from others;

where the source includes a random noise source to generate a random plurality of driving frequencies.

6. A device as in claim 5 where the noise source includes a set of selectable filters.

7. A device as in claim 5 where the output transducer comprises a piezoelectric transducer.

8. A device as in claim 7 which includes an inductor, coupled in parallel with the transducer and the source comprises a programmed processor.

9. A device as in claim 8 which includes an output specifying manually settable member.

10. An audible output device comprising:

an audible output transducer;

a programmable processor; and software for generating a sequence of driving signals for the transducer, the signals exhibiting a plurality of different frequencies with each frequency presented solely, during a respective time interval, to the transducer, with some of the time intervals different from others, the software generating each frequency for a different predetermined duty cycle, each duty cycle being less than 100%, where the software receives at least one frequency specifier from a displaced source, and where parameters pertaining to at least one of output frequency, output duty factor or output time interval can be stored in local memory coupled to the processor.

11. A device as in claim 10 which includes a manually settable member for, at least in part, specifying audible output.

12. An alarm indicating output device comprising:

an output transducer a programmable processor and executable instructions to sequentially couple a plurality of different driving frequencies to the transducer for a predetermined period;

the plurality of different driving frequencies being coupled to the transducer during respective time intervals of varying durations within the period during which each of the respective frequencies is emitted, a single frequency being emitted during each time interval; and each member of the plurality of different driving frequencies being associated with a respective, different duty factor, each duty factor being less thank 100%.

13. A device as in claim 12 with a silent interval located between emitted frequencies.

14. A device as in claim 13 which includes at least one manually settable output intensity level specifying member.

15. A device as in claim 14, the processor, responsive to the output level specifying member, adjusts at least one of output frequency, duty cycle, or time interval in accordance with a predetermined criterion.

16. A device as in claim 15 which includes a plurality of manually settable, output intensity specifying members with the processor responsive thereto to adjust output frequencies, duty cycles and time intervals.

17. A device as in claim 15 which includes an input port for receipt, from a displaced source, of at lest one frequency specifying parameter.

18. A device as in claim 17 where frequency specifying parameters can be stored in local memory coupled to the processor.

19. An alarm indicating output device comprising:

an output transducer;

a programmable processor and executable instructions to repetitively and sequentially couple at least first, second and third driving frequencies to the transducer for first, second, and third predetermined periods, respectively; and the at least first, second, and third driving frequencies being associated with at least first, second, and third duty factors, respectively, the first duty factor being different from the second and third duty factors, the second duty factor different from the third duty factor, and the first second, and third duty factors each being less than 100%.

* * * * *